United States Patent [19]

Eckel

[11] 4,106,255

[45] Aug. 15, 1978

[54] WALL PANEL ASSEMBLIES

[75] Inventor: Alan Eckel, Westford, Mass.

[73] Assignee: Eckel Industries, Inc., Cambridge, Mass.

[21] Appl. No.: 830,385

[22] Filed: Sep. 6, 1977

[51] Int. Cl.[2] ..... E04C 1/10

[52] U.S. Cl. ..... 52/582; 52/464

[58] Field of Search ..... 52/582, 584, 464–468, 52/471, 36, 459–463, 404

[56] References Cited

U.S. PATENT DOCUMENTS

| | | | |
|---|---|---|---|
| 2,822,898 | 2/1958 | Richards | 52/464 X |
| 3,320,707 | 5/1967 | Berg | 52/464 |
| 3,332,190 | 7/1967 | Ekstrom | 52/464 |
| 3,363,383 | 1/1968 | La Barge | 52/584 X |
| 3,376,678 | 4/1968 | Thygeson | 52/584 |
| 3,423,896 | 1/1969 | Widerby | 52/584 X |
| 3,724,886 | 4/1973 | Widerby | 52/464 |
| 4,038,796 | 8/1977 | Eckel | 52/221 |

*Primary Examiner*—J. Karl Bell

*Attorney, Agent, or Firm*—Schiller & Pandiscio

[57] ABSTRACT

An acoustical wall assembly comprises at least two modular sound absorbing panels. Each panel includes a substantially flat body and a tongue extending substantially parallel to and spaced from one edge of the body so as to form a channel therebetween. The tongue is provided with a flange portion which extends from the tongue away from the channel. A first connector member having two side plates each extending into a corresponding channel of two modularly-aligned panels, and a second connecting member disposed between the tongues of the adjacent panels, are secured together so as to clamp the flange portions therebetween and secure the two panels together in a coplanar relationship.

17 Claims, 7 Drawing Figures

WALL PANEL ASSEMBLIES

This invention relates to panel assemblies and more particularly to panel assemblies of the modular type.

Modular acoustical panel assemblies are well known for providing sound absorbing and attenuating walls and ceilings which are easy to construct and build with minimum effort and skill. In my copending applications Ser. No. 643,698 filed Dec. 23, 1975 now U.S. Pat. No. 4,038,796 and Ser. No. 727,034 filed Sept. 27, 1976 now U.S. Pat. No. 4,074,489, I describe improved acoustical modular panel assemblies which are easily and quickly assembled and disassembled without the need for specially designed tools. The assemblies described in both applications include identical modular panels so that any two can be assembled together. In assembling the panels together to form a wall or ceiling, each panel is aligned and oriented with respect to an adjacent panel so that two side edges of the respective panels are in a confronting and spaced relationship. Each panel includes a substantially flat body and at least one tongue which extends along a side edge of the panel substantially parallel to and spaced from the body so as to form a channel therebetween which is open along one side of the panel. The panel assemblies include connector means for connecting the panels together in an acoustically tight fashion. In order to connect the panels together in a coplanar relation, the connector means includes two preferably U-shaped connector members which join together the two confronting side edges of two adjacent panels. Each connector member comprises two parallel side plates and a web or strap connected to and supporting the side plates. Each side plate of one connector member extends within a corresponding one of the channels of each panel where it makes a tight fit with the adjacent tongue and flat body. The other connector member is fitted between the two panels so its side plates extend between and make a tight fit with the adjacent tongues of the two adjoining panels. Various types of connector means are also described in both applications for connecting two adjacent panels so as to form a corner.

Modular panels assembled in this manner have several advantages. For example, the assemblies have improved acoustical insulation and structural characteristics as well as the ability to easily accommodate doors and door frames. The use of identical modular panels enables the manufacturer to produce the panels more economically and makes the assembly of the panels easy. Finally, the use of the U-shaped connector members to connect adjacent panels provides not only a vertical load bearing column but also a raceway between panels for accommodating plumbing lines, electrical cable and the like.

The assemblies of my copending applications also include means, in the form of floor channel members to reinforce the lower longitudinal edges of the panels, secure the joined panels to the floor and also to restrain the panel connector members against separating movement. The floor channel members are preferably in the form of U-shaped members adapted to receive the bottom longitudinal edges of the panels as well as the connector members in a close, preferably tight, fit. Similarly, ceiling or roof caps are provided in order to lock together the upper ends of the connector members as well as reinforce the upper margins of each of the panels. The floor channel members and roof caps thus provide reinforcement for the upper and lower longitudinal edges of the panels, and also prevent separating movement of the connector members. However, they also can provide some inconvenience when it may become necessary to replace a panel of an assembled wall, since the connector members cannot easily be removed until they are released from the floor channel members and roof caps. Further, a particular user of the assemblies may not wish to utilize the floor channels or roof caps, because, for example, he may not wish to permanently secure the floor channels to the floor or they may be undesirable purely for aesthetic reasons. Additionally, where the panel assemblies are used as ceiling panels, the assemblies may be more difficult to handle when installing or removing a ceiling since the U-shaped connecting members are held only by frictional engagement and may not be as securely attached as desired.

Therefore, it is an object of the present invention to provide an improved modular panel assembly which includes many of the advantages of the modular panel assemblies of my copending applications Ser. Nos. 643,698 and 727,034.

Another object of the present invention is to provide an improved modular panel assembly in which the connecting members used to join adjacent panels are secured from separating movement without the need for floor channels or roof capss, so that a panel can be easily replaced without requiring disassembly or removal of several other panels from the panel assembly.

And another object of the present invention is to provide an improved modular panel assembly of the type described having a relatively improved structural connection between any two adjacent panels.

These and other objects are achieved by a panel assembly comprising at least two modular panels of the type including a substantially flat body and a tongue extending substantially parallel to and spaced from one edge of the body so as to form a channel therebetween. The tongue is provided with a flange portion which extends from the tongue away from the channel. The two panels are connected together by connecting means comprising first and second connector members so that the panels are in a substantially coplanar relationship. The first connector member has two side plates, each of which extend into a corresponding channel of the two aligned panels, and the second connector member is disposed between the tongues of the adjacent panels. Releasable means secure the first and second connectors together so as to clamp therebetween the flange portions of adjacent panels.

Other features and many of the attendant advantages of the invention are disclosed in or rendered obvious by the following detailed description which is to be considered together with the accompanying drawing in which.

In the drawings, the same numerals refer to like parts.

Figure 1:
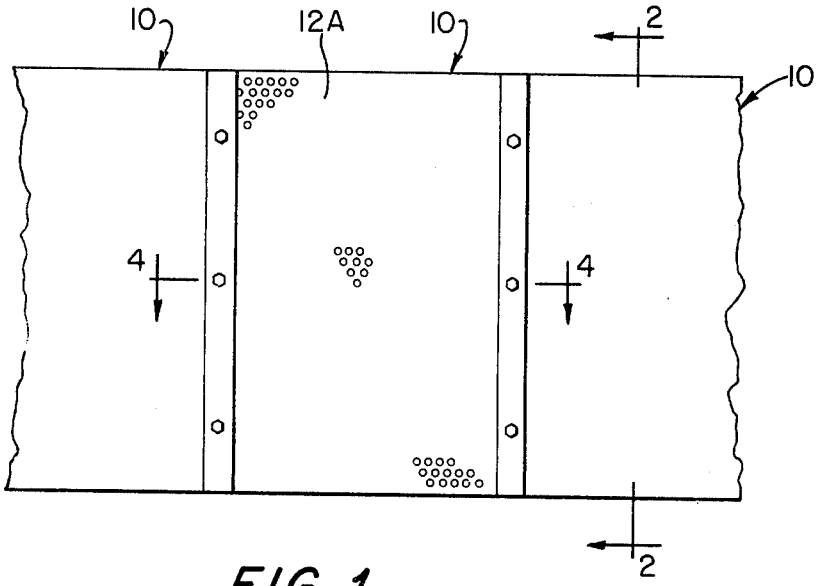
FIG. 1 is a fragmentary front view in elevation of a wall assembly including one embodiment of the present invention.

Also, for convenience of illustration, the thickness of the panels is exaggerated in the drawings. In practice, for example, the panels may measure 4 feet wide, 8 feet high and either 2 or 4 inches thick.

Figure 2:
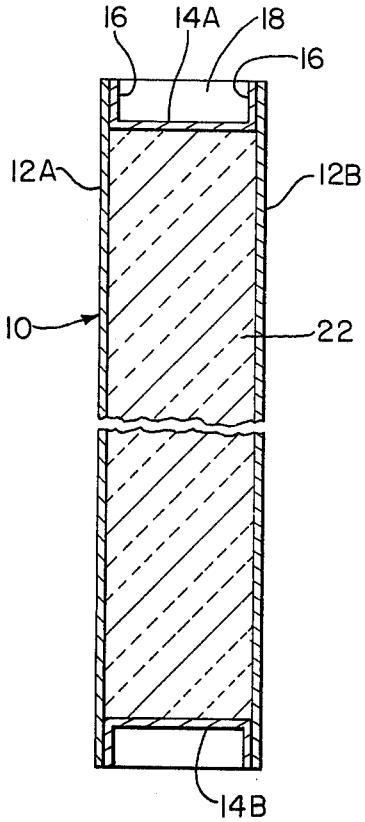
FIG. 2 is a fragmentary sectional view taken along line 2—2 of FIG. 1.
Figure 3:
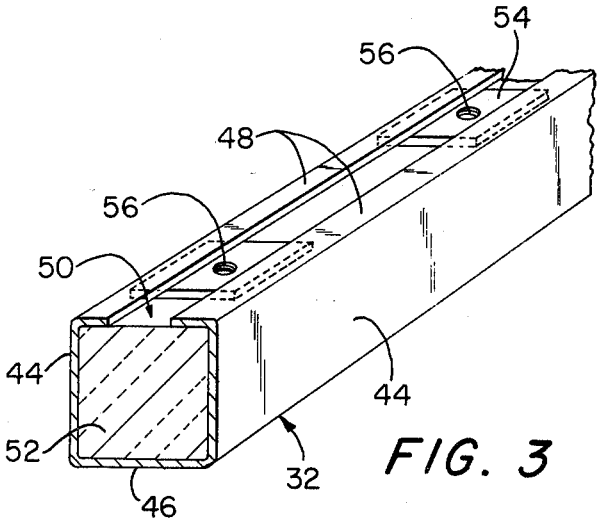
FIG. 3 is a fragmentary perspective view of a portion of the connecting means employed in the FIG. 1 embodiment.
Figure 4:
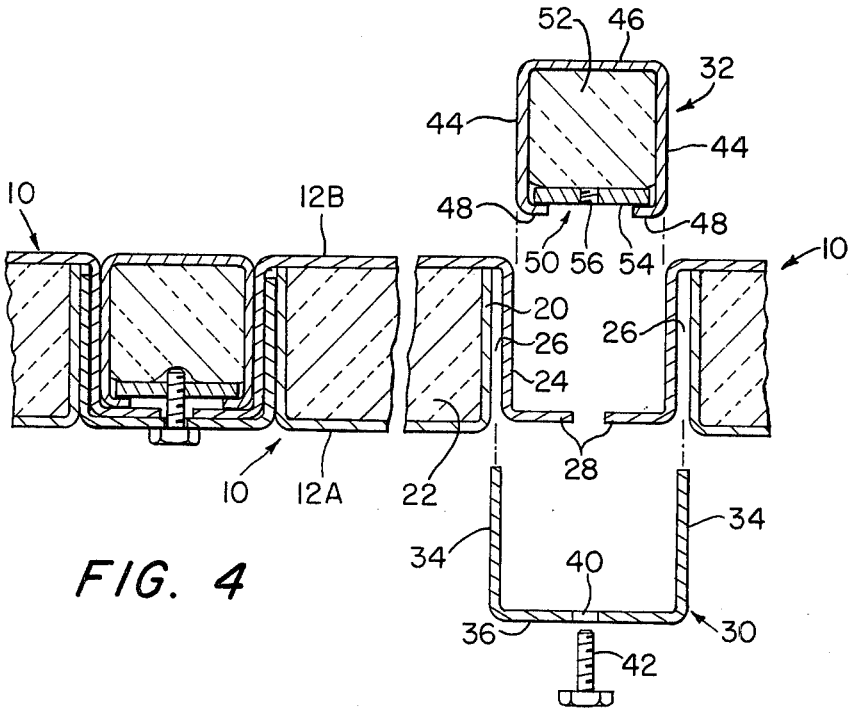
FIG. 4 is a fragmentary plan sectional view, partially exploded, of a portion of the structure of FIG. 1 taken along line 4—4 in FIG. 1.

Referring now to FIGS. 1–4, the illustrated assembly comprises at least two sound absorbing and attenuating panels 10 each including a pair of flat plates 12A and 12B mounted in a parallel and spaced relationship with respect to each other so as to form a substantially flat body. While both of the plates may be perforated (so as to render it transparent to sound) or solid, in the preferred embodiment one of the plates 12A and 12B is perforated and the other plate is not perforated. As shown in FIG. 2, the top and bottom longitudinal edges of the two plates of each panel are secured together by stiffeners 14A and 14B. Each stiffener has a pair of side flanges 16 which are secured to the inside surfaces of plates 12A and 12B and end flanges 18 which extend transversely to and are spaced from the side flanges so as to provide a relief (not shown) at each corner of the stiffener. Each plate 12A is provided with right angled side extensions 20 which, in the embodiments of FIGS. 1–4 and 7, are secured to the end flanges 18 of stiffeners 14A and 14B and serve as the side edges of the panel so as to enclose the space between plates 12A and 12B. The space is filled with a suitable sound absorbing material 22 such as glass fibers or a plastic foam. The other plate 12B is preferably formed with right angle side extensions 24, hereinafter referred to as "tongues 24." In the embodiments described in FIGS. 1–4 and 7, each tongue extends along the entire side edge of the panel and is spaced from the adjacent side extension 20 so as to form a channel 26 therebetween (see FIGS. 4 and 7) which is preferably open along one side of the panel, in this case along the side formed by plate 12A. Where one of the plates 12A and 12B is perforated, the channel 26 preferably is open on the side of the perforated plate.

To the extent described these panels are identical to those described in my prior copending applications Ser. Nos. 643,698 and 727,034. In accordance with the present invention, the panels are preferably modified so that each tongue 24 is provided with an outwardly-turned flange portion 28, each of the latter being of a predetermined width and extending substantially perpendicular to the tongue of which it is a part.

Additionally an improved connecting means is employed for connecting two adjacent panels in a coplanar relationship. The connecting means generally comprises inner and outer channel-shaped connector members 30 and 32.

Inner member 30 is preferably essentially the same as the outer U-shaped connector member described in my copending applications Ser. Nos. 643,698 and 727,034. Specifically, inner channel member 30 has two, parallel, spaced-apart side plates 34 and a strap or web portion 36 connected to and supporting the side plates at a right angle thereto. Each channel member 30 preferably extends the full height of the panels. The two adjacent panels 10 to be connected together are spaced from one another so that the side plates 34 of the channel member 30 extend into corresponding ones of the channels 26 at the confronting side edges of the two panels. Each side plate 34 makes a snug, preferably tight, fit with the tongues 24 and extensions 20 of the two panels and when the side plates 34 are properly positioned in the channels, the web portion 36 is preferably flush with or coplanar with the outer surfaces of the plates 12A of the two panels as well as in contact with the flange portions 28 of the tongues. The web portion 36 of the connector member 30 is modified from the connector shown and described in my copending applications Ser. Nos. 643,698 and 727,034 so as to include at least one and preferably a plurality of apertures 40 which are located substantially centrally between side plates 34 and are longitudinally spaced from one another. The web portion 36 is dimensioned so that when connector member 30 is connecting two panels together a space is provided between the flange portions 28 which is sized to allow the threaded portion of a bolt 42 to extend through the aperture 40 between the flange portions 28.

The outer connector member 32 of the embodiment shown in FIGS. 1–4 is similar to the batten described in Canadian Patent No. 1,007,991, issued Apr. 5, 1977 to Oliver C. Eckel. Specifically, the outer connector member 32 is essentially U-shaped, having two oppositely disposed, parallel, spaced-apart side plates 44, each of which are integrally connected at right angles to an opposite edge of a strap or web portion 46. The edges of the side plates opposite the web portion 46 are formed with inwardly directed lips 48 so as to provide a space 50 therebetween. Member 32 preferably extends the full height of the panels and is filled with sound absorbing material 52, which bears against the side plates 44 and web portion 46 and is resilient when compressed. One or more flat retaining plates 54 are provided, each having a substantially centrally-located threaded hole 56 and dimensioned so that each can be inserted diagonally in the space 50 between the lips 48, into the interior of the connector member, pressed against the material 52 and reoriented so that the side edges of the retaining plate are biased into contact with the lips 48 by the resilient material 52. The connector member 32 is dimensioned so as to snugly fit between the tongues 24 of adjacent panels so that the lips 48 contact the flange portions 28 of adjacent panels, while the web portion 46 is substantially flush or coplanar with the plates 12B of the two panels. When plate 54 is positioned between the panels, its threaded hole 56 is aligned with aperture 40 of the inner connector member 30, so that bolt 42 extending through the aperture 40 and between the flange portions 28 of the panels 10 can be screwed into the aperture 56 and thus draw retaining plate 54 and connector member 32 toward connector member 30 and flanges 28. The connection formed by the inner and outer channel members 30 and 32 essentially secures each tongue 24 between the side plates 34 and 44 of the outer and inner connector members, respectively, and clamps its flange portions 28 between the lips of the outer connector member 32 and the web portion 36 of the inner connector member 30. By securing the bolt 42 to the retaining plate 54 a vertical post or column is provided for structurally supporting the two adjacent modular panels 10 in a coplanar relationship which is more rigid and secure than the corresponding structure of the panel assemblies disclosed in my aforesaid copending applications.

Figure 5:
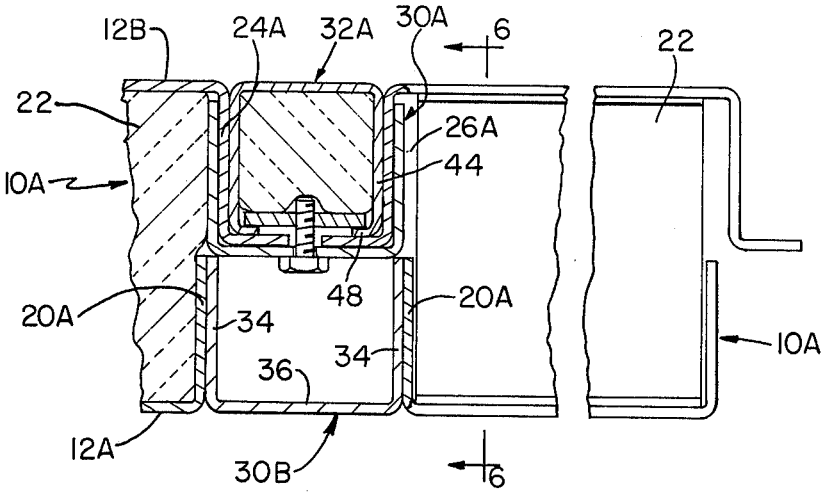
FIG. 5 is a fragmentary plan sectional view illustrating a second embodiment of the present invention.
Figure 6:
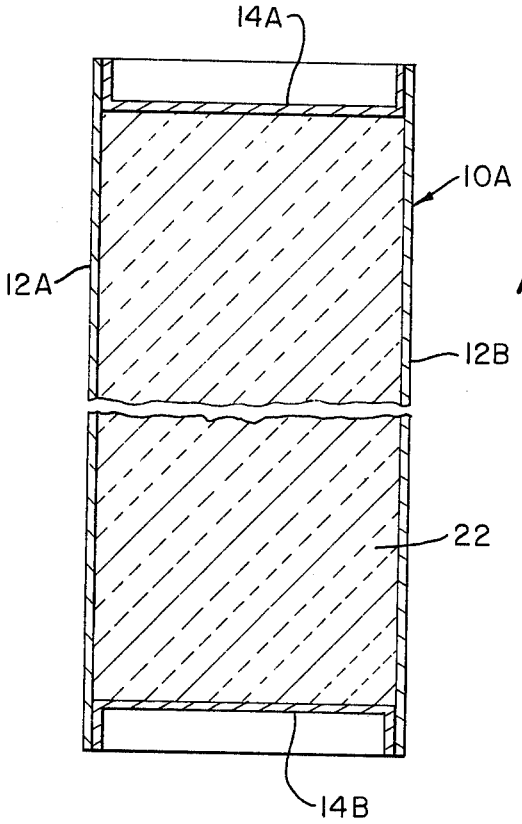
FIG. 6 is a fragmentary sectional view taken along line 6—6 of FIG. 5.

In a modified form of the present invention shown and described in FIGS. 5 and 6, the panels 10A are made identical to panels 10, except that the side extensions 20A of the plates 12A only extend about half the width of the panel from one side of the panel and the tongues 24A together with their flange portions 28 formed by the plates 12B extend only about half the width of the panel from the opposite side of the panel. The side extensions 20A are preferably not secured to the upper and lower stiffener members 14A and 14B but are made flexible toward and away from the resilient material 22, with the extensions being made at an angle slightly greater than 90° with respect to the frontal portion of the plate 12A, i.e., so that the side extension of one panel converges toward the confronting side extension of the adjacent panel, for reasons which will become more apparent hereinafter. The channel 26A formed between the tongues and the side edges of the body is actually formed by the tongue and the resilient material 22 of the panel. Two adjacent panels 10A are connected together by utilizing connector members 30A and 32A identical to those previously described except that the side plates of both members are dimensioned to extend only half the width of each panel when two adjacent panels are connected together. Specifically, the side plates of inner connector member 30A extend into the channels 26A of the two adjacent panels, making a snug and preferably a tight fit with the tongues 24 and the resilient material 22, while the outer connector member 32A extends between the tongues so that the side plates 44 and lips 48 make contact with the confronting tongues 24A and the flange portions 28 respectively. The bolt 42 and retaining plate 54 are used to secure the connector members together and clamp the tongues 24A and flange portions 28 therebetween. Once the inner and outer connecting members secure two adjacent panels together, a recess is formed which is sized to receive a third connector member 30B. The latter may be identical to the inner connecting member 30A and thus includes the side plates 34 and web portion 36; preferably, however, connector member 30B lacks a hole like that one in connector member 30A for bolt 42. Since the extensions 20A are made at an angle slightly greater than 90° with respect to the side plates 12A, insertion of third connector member 30B between the two panels results in the side plates 34 biasing the side extensions of the adjacent panels away from one another against the material 22. This results in a snug, preferably tight, fit between the connector member 30B and the side extensions 20A. In position, the side plates of connector 30B substantially abut the member 30A while the web portion 36 is substantially coplanar with panel 12A. Similarly, the web portion 36 of connector member 32A is substantially coplanar with plates 12B.

The embodiment of FIGS. 5 and 6 provides the advantage that the hollow column thus formed by connector 30B hides the bolt 42 from view, making the appearance of the panel aesthetically more pleasing. Secondly, panels 10A can be made twice the thickness of panels 10 while employing the same sized connecting members. Thirdly, the hollow column formed by the third connecting member 30B and web portion 36 of the inner connecting member 30A can easily function as a raceway for electrical cables, piping or the like. In such a situation, although not shown, where building codes require it, the bolts 42 can be countersunk with respect to the web portion 34 of connector 30A so that the heads of the bolts are substantially flush with the web portion.

Figure 7:
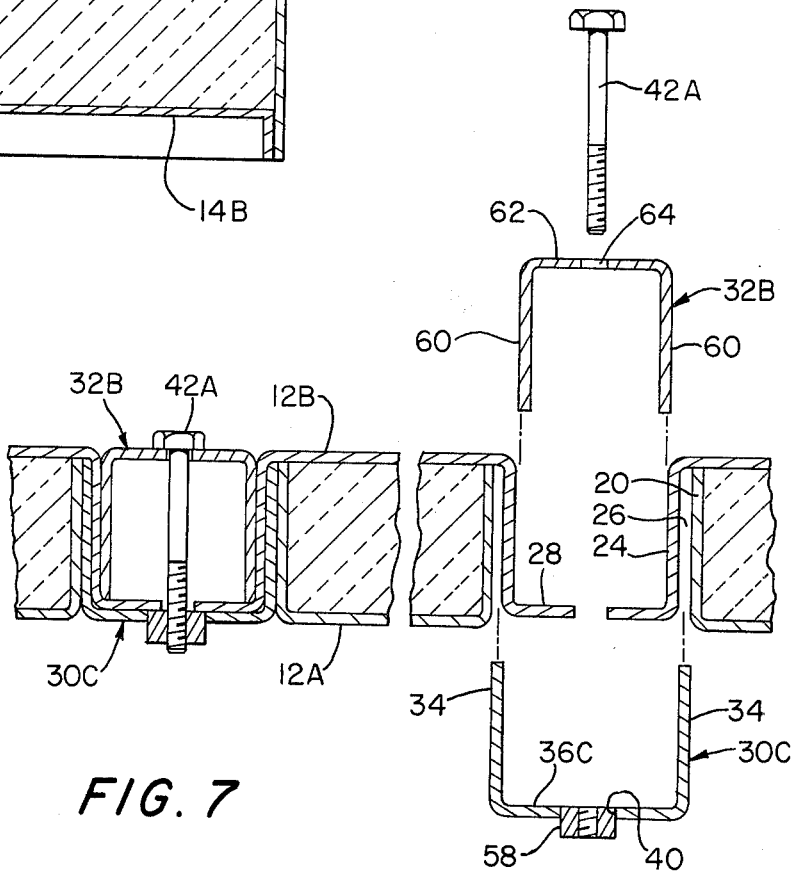
FIG. 7 is a fragmentary plan view, partially exploded, of the third embodiment of the present invention.

A further modified form of the present invention is shown in FIG. 7. In this embodiment, each aperture 40 of the web portion 36C of the inner connector member 30C is provided with a threaded insert 58 which is welded or otherwise secured in place, and the outer connecting member 32B is replaced by the member 32A. The insert is provided with a width dimension larger than the space provided between the flange portions 28 when two adjacent panels are connected together. The member 32B is similar to the inner connector member of my copending applications Ser. Nos. 643,698 and 727,034, with member 32B including side plates 60 oppositely disposed and parallel to one another and integrally joined at right angles to a web portion 62. The web portion 62 is provided with apertures 64 which correspond to threaded inserts 58, so that when the side plates 34 of connector member 30C are inserted in the respective channels 26 of adjacent panels and connecting member 32B is inserted between the tongues 24 of adjacent panels, the bolt 42A can be inserted through each aperture 64 between flange portions 28 and screwed into the corresponding threaded insert 58. In this manner, the side plates 60 of connector 32B clamp the flange portions 28 of the adjacent panels against the web portion 36C of connecting member 30C, the web portion 62 is substantially flush with the plates 12B of the adjacent panel and the web portion 36C is substantially flush with plates 12A.

The assembly thus described provides a modular wall and/or ceiling assembly which has relatively improved acoustical insulation and structural properties without the need for floor and ceiling channel or cap connecting members. Further, with respect to the embodiments shown in FIGS. 5 and 7 the joints can easily accommodate water and heating pipes, electrical cable and the like through the raceway provided. Further, the assembly utilizes identical panels for both wall and ceiling structures. Additionally, by dimensioning each of the panels 10 to that of the size of a standard door frame and doors, a door frame and door can easily be substituted for one of the panels, thus making it easy to adapt the assembly to present construction demands. Also the plates 12A and 12B, as well as the stiffeners may be made of metal and connected together by spot welding or rivets. Alternatively, they may be made of plastic materials and locked together by a cement or suitable fasteners or ultrasonic welding.

Obviously, certain changes may be made in the above apparatus without departing from the scope of the invention herein involved. Thus, for example, the tongues 24 of adjacent panels may not extend the full length of the panels 10 but instead may be slotted so as to form two or more smaller tongues spaced along the edge of the panel. Other possible changes are to use means other than the resilient sound absorbing material 52 to hold the retaininer plates 54 in place when they are not attached to bolts 42, and not filling or only partially filling connector member 32 with insulation 52 so as to allow a portion of the interior space of the connector member to function as a raceway. Still other changes will be obvious to persons skilled in the art. Therefore, it is intended that all matter contained in the above description and shown in the accompanying drawings shall be interpreted in an illustrative and not in a limiting sense.

It is to be understood that as used in the appended claims, the term "wall assembly" denotes either a wall or ceiling or floor.

What is claimed is:

1. A modular wall assembly comprising in combination:

at least two panels each including a substantially flat body, a tongue at an edge of said body extending substantially parallel to and spaced from said body so as to form a channel therebetween, and a flange portion carried by said tongue and extending away from said channel, said panels being aligned and oriented so that said edges are in mutually confronting and spaced relationship;

a first connector member having two parallel spaced-apart side plates and a web connected to and supporting said side plates, each of said side plates extending within a corresponding one of said channels and making a snug fit with the adjacent tongue and flat body;

a second connector member having two parallel spaced-apart side plates and a web connected to and supporting said side plates, the side plates of said second connector extending between and making a snug fit with said tongues; and means associated with said first and second connector members for securing said members together so as to clamp said flange portions therebetween.

2. An assembly in accordance with claim 1 wherein said means for securing includes a bolt extending between said flange portions of the adjacent panels.

3. An assembly in accordance with claim 1 wherein said second connector member further includes oppositely disposed inwardly turned lips formed on said side plates, and said assembly further comprises at least one plate disposed within said second connector and adapted to be connected to said first connector and drawn tight against said oppositely disposed lips.

4. An assembly in accordance with claim 3 having means for biasing said plate against said oppositely disposed lips.

5. An assembly in accordance with claim 4 wherein biasing means is a resilient sound-absorbing material.

6. An assembly in accordance with claim 3 further including a bolt extending between said flange portions of the said two panels and coupled to said plate.

7. An assembly in accordance with claim 1 wherein said first connector member is a U-shaped channel member.

8. An assembly in accordance with claim 1 wherein said second connector member is a U-shaped member.

9. An assembly in accordance with claim 1 wherein one of said connector members includes at least one threaded insert and the other connector includes at least one aperture corresponding to said insert, and said means for securing said connectors includes at least one bolt extending through said aperture and secured to said insert.

10. An assembly in accordance with claim 9 wherein said connector members are each U-shaped members and said web portions of said connectors are respectively substantially coplanar with the opposite sides of said panels.

11. An assembly in accordance with claim 1 wherein each of said panels further includes a side plate at said one edge of said body spaced from said tongue and forming with said tongue said channel.

12. An assembly in accordance with claim 1 wherein each of said panels includes parallel, oppositely disposed sides, and further wherein said web portion of one of said connector members is substantially coplanar with one side of said panels and said web portion of the other connector member is disposed between the opposite sides of said panels so as to form a recess between said panels.

13. An assembly in accordance with claim 12 further including a third connector member disposed in said recess.

14. An assembly in accordance with claim 13 further including means for retaining said third connector member in said recess.

15. An assembly in accordance with claim 14 wherein each panel comprises a pair of spaced wall plates, one of said plates includes at least one resilient side extending portion along said edge of the panel for releasably and frictionally retaining said third connector member in said recess.

16. An assembly in accordance with claim 15 wherein said third connector member includes two-side plates and a web portion connected to and supporting said side plates, each of said side plates extending between and making a snug fit with said side extending portions of said panels.

17. An assembly in accordance with claim 13 wherein said third connector member is a U-shaped channel member and coacts with said first and second connector members to form a hollow column between said panels.

* * * * *